United States Patent [19]

Wilmes

[11] Patent Number: 4,563,054

[45] Date of Patent: Jan. 7, 1986

[54] SPRING-PRESSURE CONNECTOR FOR ELECTRICAL CONDUCTORS

[75] Inventor: Manfred Wilmes, Detmold, Fed. Rep. of Germany

[73] Assignee: C. A. Weidmuller GmbH & Co, Detmold, Fed. Rep. of Germany

[21] Appl. No.: 528,762

[22] Filed: Sep. 2, 1983

[30] Foreign Application Priority Data

Oct. 19, 1982 [DE] Fed. Rep. of Germany ..... 3238699

[51] Int. Cl.[4] ..... H01R 11/22; H01R 4/50

[52] U.S. Cl. ..... 339/254 R; 339/274

[58] Field of Search ..... 339/95 R, 95 A, 97 R, 339/97 P, 254 R, 254 M, 270 R, 274

[56] References Cited

U.S. PATENT DOCUMENTS

| | | | |
|---|---|---|---|
| 2,466,930 | 4/1949 | Cook | 339/95 R |
| 2,908,884 | 10/1959 | Wirsching | 339/274 |
| 3,140,909 | 7/1964 | Danesi | 339/274 |
| 3,675,182 | 7/1972 | Gregory | 339/274 |
| 3,973,822 | 8/1976 | Sugimoto | 339/274 |
| 4,029,383 | 6/1977 | Harding et al. | 339/274 |

FOREIGN PATENT DOCUMENTS

| | | | |
|---|---|---|---|
| 2416441 | 2/1976 | Fed. Rep. of Germany . | |
| 2730680 | 1/1979 | Fed. Rep. of Germany . | |
| 2713494 | 4/1979 | Fed. Rep. of Germany . | |
| 1565519 | 4/1980 | United Kingdom | 339/95 R |

*Primary Examiner*—Gil Weidenfeld
*Assistant Examiner*—Gary F. Paumen
*Attorney, Agent, or Firm*—Sprung Horn Kramer & Woods

[57] ABSTRACT

A spring-contact connector for electric conductors, with a contact spring and an activating element that is mounted in such a way that it can rotate. The activating element is a more or less rotationally symmetrical member mounted in such a way that it can rotate between the contact spring and a counterbearing piece. The spring has a recess below a contact web on the free end thereof. A conductor seating is disposed at one side of and along the longitudinal axis of the activating element and is intersected by a transverse slot that accepts the contact web.

12 Claims, 5 Drawing Figures

SPRING-PRESSURE CONNECTOR FOR ELECTRICAL CONDUCTORS

BACKGROUND OF THE INVENTION

The present invention relates to a spring-pressure connector for electric conductors with a contact spring and an activating element that is mounted in such a way that it can rotate.

Mounting separate activating elements in such a way that they can rotate in a clip housing to release an established pressure connection is known from German OS No. 2 730 680. Such a design, however, requires space for the activating element that is not available in many applications, involving long connector strips or connectors that have insertion tabs for connection to printed circuits and similar devices for instance, specifically in cases that may not involve clip housings.

Clip connectors that deviate to some extent from the generic type in that they lack a contact spring and in which an activating element is mounted in such a way that it can rotate in a clip framework are also known. The activating element in this type of connector grips the conductor in a contact position either with an eccentric cam as is taught in German AS No. 2 416 441 or in accordance with the depth to which it is screwed in as is taught in German AS No. 2 713 494.

SUMMARY OF THE INVENTION

The object of the present invention is to provide a spring-contact connector of the same generic type that can be activated in a minimum of space.

This and other objects are achieved in accordance with the invention by a spring-contact connector for electrical conductors, with a contact spring and an activating element that is mounted in such a way that it can rotate, wherein a more or less rotationally symmetrical activating element is mounted in such a way that it can rotate between the contact spring and a counterbearing piece, wherein a recess in the contact spring is below a contact web on the free end of the contact spring, and wherein a conductor seating is at one side of and along the longitudinal axis of the activating element and intersected by a transverse slot that accepts the contact web.

The particular embodiment with a recess in the contact spring below a contact web and with a transverse slot that accepts the contact web in the spring-pressure position, in which position the activating element is twisted until the lower edge of the contact web on the spring contacts a conductor wire in a conductor seating in the activating element to establish a spring-pressure connection, makes it possible to accommodate the rotating activating element in a minimum amount of space in the vicinity of the contact spring, for which, in addition to the contact spring itself, practically the only other component that is necessary is a counterbearing piece that faces it and that the contact spring can be bent out of. Thus, practically no additional space beyond that occupied at any rate by an appropriately bent contact spring is needed, whereas a spring-contact connection of this type can be both established and released in a minimum amount of space by turning the activating element out of an open position, in which the conductor seating faces away from the contact web on the spring, into a contact position, in which the inserted conductor is gripped and contacted by the contact web, which rests in this position in the transverse slot in the activating element.

One particular advantage of the invention is that no housing space or the like is needed for mounting the activating element. Spring-pressure connectors of this type can accordingly be employed with no difficulty with long connector strips or with very small separate connectors with solder tabs for attachment to printed-circuit boards and similar devices.

Further preferred embodiments of a spring-pressure connector of this type that provide in particular various possibilities for slightly sloping the position of the contact web and the conductor in the contact position and for easily securing the spring-contact connector in the open position as well as various possibilities for twisting or turning and positioning the activating element are envisioned. For example, the activating element preferably has a continuous positioning groove around it at the level of the transverse slot that accepts the contact web of the contact spring and the top of the activating element has a head with a screwdriver slot. Moreover, the activating element preferably has an inwardly offset cylindrical portion below the head and above the continuous positioning groove and transverse slot and another offset cylindrical portion therebelow which terminates in a conical portion.

The counterbearing piece may be flat-surfaced and the offset cylindrical portions of the activating element are preferably subjected to pressure by the contact spring, the recess of which is dimensioned to allow partial penetration by the activating element. The counterbearing piece is part of a connector strip.

In another embodiment, the counterbearing piece is rounded off at the upper end, which operates in conjunction with the cylindrical portions on the activating element to conform to the shape of that element and wherein the activating element is subjected to pressure from the contact spring.

Preferably, the contact spring is in one piece with and bent out of the counterbearing piece. Moreover, spring-contact connector may have a lateral flattening on the activating element on the side of the conductor seating that operates in conjunction with the flat surface of the counterbearing piece when the connector is in the open position. Further, the activating element may have a lateral flattening on the side diametrically opposite the conductor seating below the transverse slot and extending beyond the lower cylindrical portion and part of the conical portion.

Still further, the contact web may have a slanted position and the floor of the transverse slot extends closer to the central longitudinal axis of the activating element than the conductor seating otherwise does. A positioning slope is preferably disposed between the bottom inside edge of the transverse slot and the conductor seating and the bottom of the head of the activating element is guided along the top of the counterbearing piece.

One embodiment of the invention will now be described by way of example with reference to the drawings, in which:

DETAILED DESCRIPTION OF THE INVENTION

Figure 1:
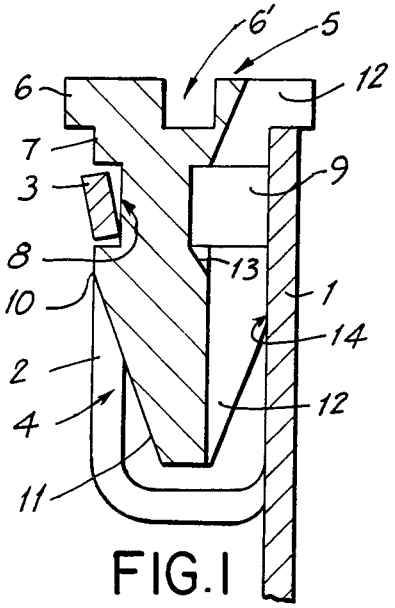
FIG. 1 is a longitudinal section through a spring-pressure connector, in accordance with the present invention, in the open position.
Figure 2:
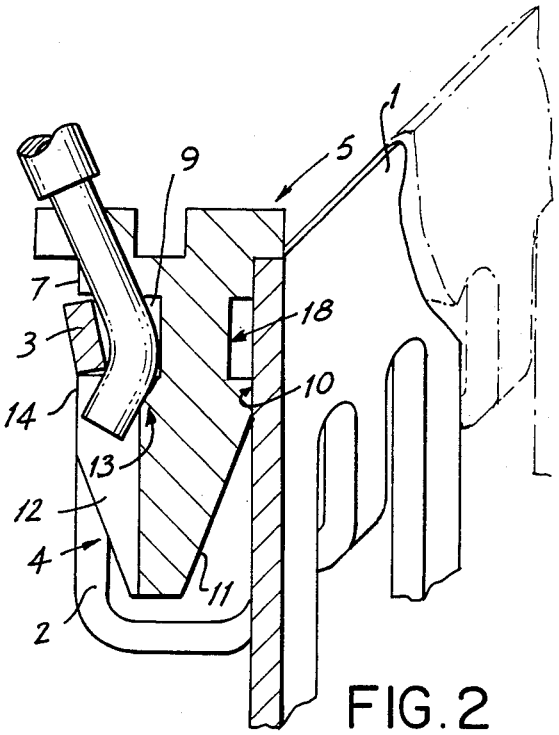
FIG. 2 is a longitudinal section through the spring-pressure connector of FIG. 1, in the closed position.

In the spring-contact connection illustrated in FIGS. 1 and 2, a contact spring 2 has been bent out of a counterbearing piece 1 in such a way that the spring and the counterbearing piece form a more or less U-shaped seating as seen from the side. Counterbearing piece 1 can simultaneously be part of a connector strip, for example, as illustrated by the broken line in FIG. 2, in which case a number of similar spring-pressure connectors will be formed in sequence along the connector strip. Counterbearing piece 1 can also have, however, only a single soldering or insertion tab on the bottom for example.

The free end of contact spring 2 is a transverse contact web 3 and is divided along most of its extent by a recess 4 below this web. Recess 4 is shaped and dimensioned below contact web 3 in such a way that an activating element 5, which is to be described in detail in the following, can extend partly through it as is evident in particular from FIG. 3.

The activating element 5 in the embodiment illustrated in FIGS. 1 and 2 has a cylindrical head 6 on the top with a slot 6' that allows it to be manipulated with a screwdriver. There is a cylindrical inwardly displaced offset 7 below head 6. Below cylindrical offset 7, along the length of activating element 5, is a continuous circumferential positioning groove 8 in which contact web 3 rests when the connector is in the open position (see FIG. 1) and over extensive parts of the path of rotation of activating element 5 in the closed position. At the same level as continuous positioning groove 8 there is also a transverse slot 9 in one side of activating element 5. The floor of transverse slot 9 extends close to the longitudinal axis of activating element 5. Below continuous positioning groove 8 and transverse slot 9 activating element 5 terminates in another small cylindrical offset 10 and in a cone 11 that merges into the offset and points downward.

There is also a seating 12 for the electric conductor in activating element 5. Conductor seating 12 passes, on the side of the activating element that contains transverse slot 9, first through head 6 and cylindrical offset 7, then, with an appropriate cut through transverse slot 9, and finally through cylindrical offset 10 and cone 11. The floor of transverse slot 9 extends, in the vicinity of the cut into offset 7, somewhat closer to the longitudinal axis so that an inserted electric conductor will be subjected to a slight buckling in that area as will be evident from FIG. 2. This facilitates, as will also be evident from FIG. 2, the desired hooking action and hence pressure contact of the lower edge of contact web 3 with the inserted electrical conductor when the spring-contact connector is in the closed position. This pressure contact with the lower edge of contact web 3 is also ensured by slightly sloping the web itself by means of a slight bend in the end of contact spring 2.

As will be evident from FIG. 2, contact web 3 extends in the closed position unobstructedly into transverse slot 9 so that with respect to the depth of the slot here electrical contact with different diameter conductors can be established.

There is also a slight positioning slope 13, against which the inserted electric conductor can rest, in the transition between the floor of transverse slot 9 that extends farther in and conductor seating 12, specifically the lower transition.

In the embodiment illustrated in FIGS. 1 and 2, the rotating mounting of activating element 5 is created by allowing contact web 3 to rest in positioning groove 8 when the connector is in the open position and over extensive portions of the path of rotation of rotating part 5, subject to slight tension on the part of contact spring 2, while cylindrical offsets 7 and 10 of activating element 5 press against counterbearing piece 1 so that the head 6 of activating element 5 can also be positioned at the top against counterbearing piece 1.

It is practical for activating element 5 to have a flattening 14 on the side against which conductor seating 12 rests on the outside in the vicinity of cylindrical offset 10 and also if necessary in the vicinity of cylindrical offset 7. Flattening 14 is positioned so that it will rest against the wall, which is flattened to this extent, of counterbearing piece 1 in precisely the open position of the connector in which conductor seating 12 is diametrically opposite contact spring 2. This will slightly secure the spring-pressure clip in the open position so that the connector will be kept open while being stored, transported, and mounted.

Once an electrical conductor has been inserted into conductor seating 12 and the essentially rotationally symmetrical activating element 5 has been twisted 180°, the spring-pressure connector will be in the closed position (FIG. 2) and can be opened again by twisting element 5 back.

Figure 3:
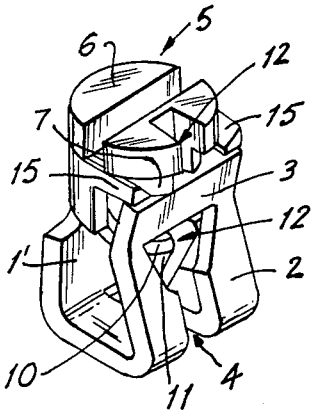
FIG. 3 is a perspective view of another spring-pressure connector of the same type in accordance with the present invention.
Figure 4:
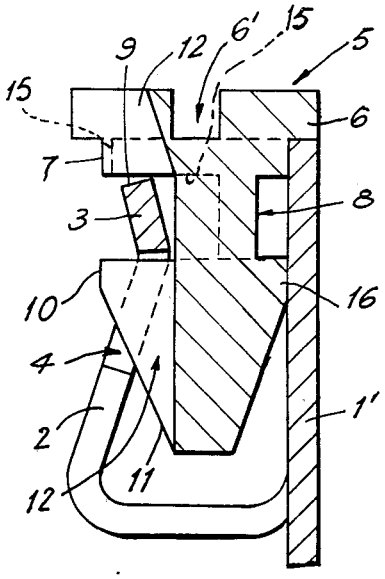
FIG. 4 is a longitudinal section through the spring-pressure connector of FIG. 3.
Figure 5:
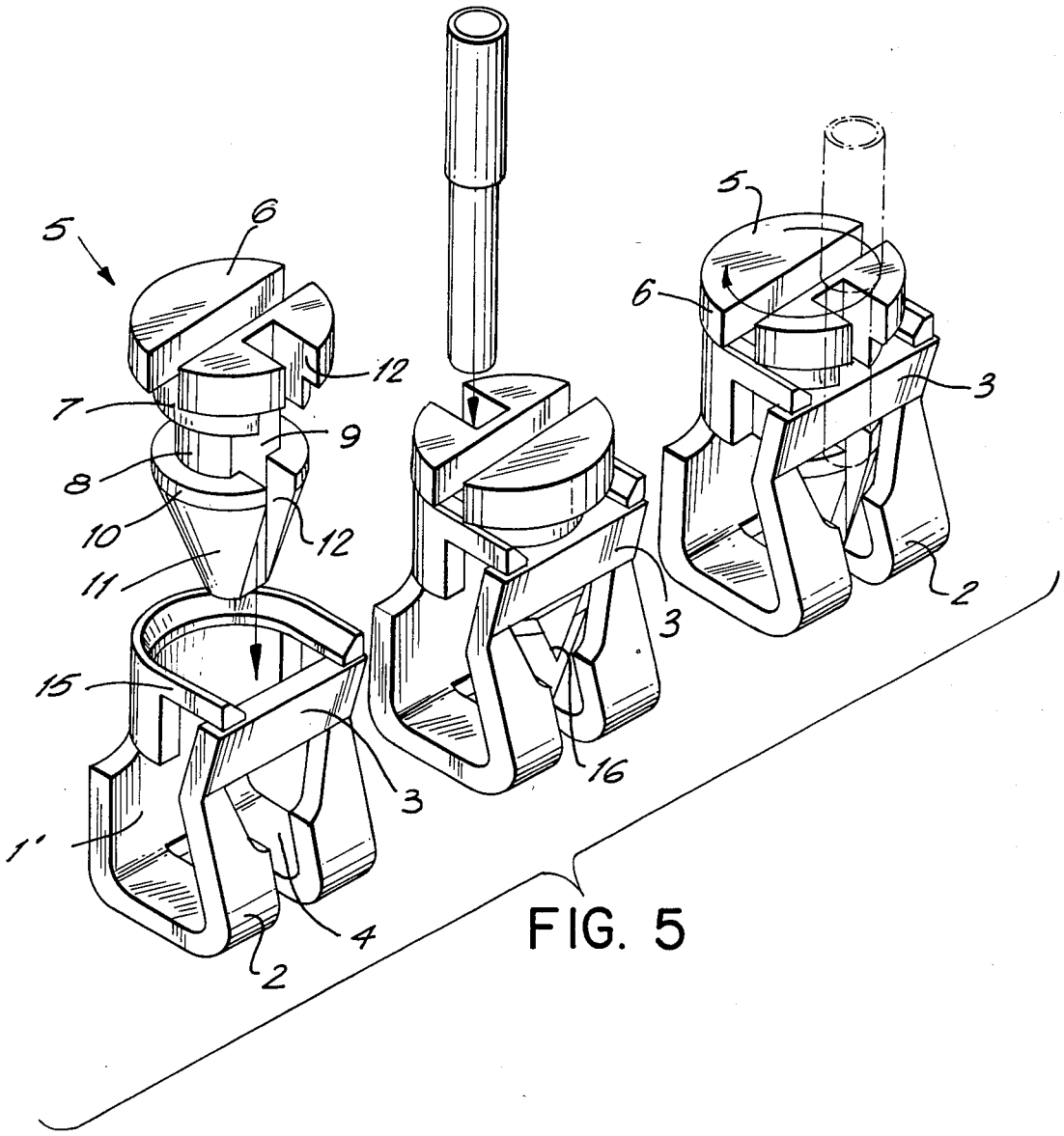
FIG. 5 is a further perspective view of FIG. 3 as it is being assembled and operated.

In the embodiment illustrated in FIGS. 3 and 4, counterbearing piece 1', although its basic design is the same, is rounded off at the upper end, which operates in conjunction with the top of activating element 5, to conform to the shape of that element, resulting in an especially satisfactory and precise twist mounting for element 5 which is mounted from the top as shown in the leftmost connector in FIG. 5. There are also positioning curves 15 at the top of counterbearing piece 1' that still extensively surround activating element 5 to above the upper edge of contact spring 2 and enclose cylindrical offset 7 below the head 6 of activating element 5. Head 6 can be guided along positioning curves 15 at the bottom thereof. Positioning curves 15 reliably prevent a conductor that has been inserted into conductor seating 12 in the open position from escaping laterally from the seating again while activating element 5 is being twisted.

In this embodiment as well, the contact web 3 of contact spring 2, rests subject to slight tensioning, in the positioning groove 8 in activating element 5 when the spring-contact connector is in the open position and over extensive portions of the element's twisting motion and forces the element securely into the rounded off area formed in this case in counterbearing piece 1'.

Furthermore, the activating element 5 in this embodiment has a lateral flattening 16 diametrically opposite conductor seating 12 and extending beyond cylindrical offset 10 and cone 11 up to continuous positioning groove 8. When the spring-contact connector is in the open position as shown in the central connector in FIG. 5, flattening 16 will accordingly be positioned in the vicinity of the recess 4 in the forked contact spring 2 and a conductor can be inserted. When the connector is in the closed position as shown in the rightmost connector in FIG. 5, in which contact web 3 can penetrate far into transverse slot 9, however, flattening 16 will rest against counterbearing piece 1', allowing activating element 5 a certain amount of play and potential for adjustment, even in the sense of a slight slanting position, which promotes on the one hand the securing of conductors with different diameters and on the other a hooking of contact web 3 to the electric conductors to help secure the clamping action.

In the embodiment illustrated in FIGS. 3 and 4, the force of activating element 5 against the corresponding rounding off in the counterbearing piece makes the element so relatively tight, as a result of contact web 3 resting in positioning groove 8, that the element will remain in place once it has been twisted into the open position.

It will be appreciated that the instant specification and claims are set forth by way of illustration and not limitation, and that various modifications and changes may be made without departing from the spirit and scope of the present invention.

What is claimed is:

1. In a spring-contact connector for electrical conductors, having a contact spring, an activating element and means mounting the activating element for rotation, the improvement wherein the activating element is substantially rotationally symmetrical and includes a conductor seating at one side thereof and along the longitudinal axis, a transverse slot intersecting the seating, a continuous positioning groove around the activating element at the level of the transverse slot, a head and a shoulder below the head and above the continuous positioning groove and transverse slot and wherein the means mounting the activating element comprises a counter bearing member having a top surface abutting the shoulder to limit downward movement of the activating element and a contact web at a free end of the spring, wherein the contact spring and web are integral with and bent out of the counterbearing member into a substantially U-shaped configuration having two arms and a base receiving the activating element therein with the counterbearing member forming one arm, the web and a portion of the spring forming the other arms and another portion of the spring forming the base, said other arm and said base being cantilevered from said one arm, wherein the contact web is aligned with the transverse slot and has a recess below the web configured to receive a portion of the activating element such that the contact web is received in the slot upon rotation of the activating element between the contact web and the counterbearing member with a portion of the web above the recess abutting the positioning groove to limit upward movement of the activating element.

2. The spring-contact connector as in claim 1, wherein the head has a screwdriver slot therein to facilitate turning.

3. The spring-contact connector as in claim 2, wherein the activating element has a first inwardly offset cylindrical portion below the head and above the continuous positioning groove to form the shoulder and transverse slot and a second inwardly offset cylindrical portion below the first portion and which terminates in a conical portion.

4. The spring-contact connector as in claim 3, wherein the counterbearing member has a flat surface and the cylindrical portions of the activating element are subjected to pressure between the counterbearing member and the contact spring.

5. The spring-contact connector as in claim 4, wherein the counterbearing member is part of a connection strip.

6. The spring-contact connector as in claim 3, wherein the activating element has the first and second inwardly offset cylindrical portions above and below the slot and wherein the counterbearing member has a rounded portion conforming to the shape of the cylindrical offset portions on the activating element.

7. The spring-contact connector as in claim 4, wherein the activating element has a lateral flattening on the side of the conductor seating that coacts with the flat surface of the counterbearing member when the connector is in the open position.

8. The spring-contact connector as in claim 4, wherein the activating element has a lateral flattening on the side diametrically opposite the conductor seating below the transverse slot and extending beyond the second cylindrical portion and part of the conical portion.

9. The spring-contact connector as claim 1, wherein the contact web has a slanted orientation relative to the longitudinal axis of the activating element.

10. The spring-contact connector as in claim 1, wherein the floor of the transverse slot extends closer to the central longitudinal axis of the activating element than that of the conductor seating.

11. The spring-contact connector as in claim 10, further comprising a positioning slope between the bottom inside edge of the transverse slot and the conductor seating.

12. The spring-contact connector as in claim 4, wherein the bottom of the head of the activating element is guided along the top of the counterbearing piece.

* * * * *